United States Patent [19]

Svoboda

[11] 4,268,064

[45] May 19, 1981

[54] SOLE HOLDER

[75] Inventor: Josef Svoboda, Schwechat, Austria

[73] Assignee: TMC Corporation, Baar, Switzerland

[21] Appl. No.: 27,449

[22] Filed: Apr. 5, 1979

[30] Foreign Application Priority Data

Apr. 6, 1978 [AT] Austria ..... 2418/78

[51] Int. Cl.[3] ..... A63C 9/085

[52] U.S. Cl. ..... 280/625; 280/628; 280/633

[58] Field of Search ..... 280/625, 626, 628, 633, 280/611

[56] References Cited

U.S. PATENT DOCUMENTS

| | | | |
|---|---|---|---|
| 3,095,209 | 6/1963 | Covini | 280/626 |
| 3,632,123 | 1/1972 | Salomon | 280/628 |
| 3,822,071 | 7/1974 | Mottet | 280/625 |
| 3,902,730 | 9/1975 | Tschida et al. | 280/625 |
| 3,950,002 | 4/1976 | Schweizer et al. | 280/625 |
| 4,088,343 | 5/1978 | Krob | 280/625 |
| 4,166,636 | 9/1979 | Svoboda et al. | 280/625 |
| 4,170,372 | 10/1979 | Salomon | 280/628 |

FOREIGN PATENT DOCUMENTS

| | | | |
|---|---|---|---|
| 2504426 | 8/1975 | Fed. Rep. of Germany | 280/626 |
| 404497 | 6/1966 | Switzerland | 280/626 |

*Primary Examiner*—David M. Mitchell

*Attorney, Agent, or Firm*—Blanchard, Flynn, Thiel, Boutell & Tanis

[57] ABSTRACT

A device for engaging and holding a sole of a ski boot, which device includes a sole holder which is adjustable in a vertical direction relative to the ski by means of an adjusting screw and is connected to a ski binding part which is associated therewith. The adjusting screw is secured to the ski binding part and is prevented from lifting off in a vertical direction from the ski while at the same time is swivelably supported on a base plate. The sole holder can, during an automatic release operation (safety release) be swung slightly upwardly from the ski on a side of the ski facing the release side. The sole holder performs a normal pivotal movement with respect to the longitudinal axis of the ski or a combined pivotal and swivel movement about differing pivot axes. Structure is provided for urging the sole holder into a normal ski boot holding position.

15 Claims, 16 Drawing Figures

Fig. 10
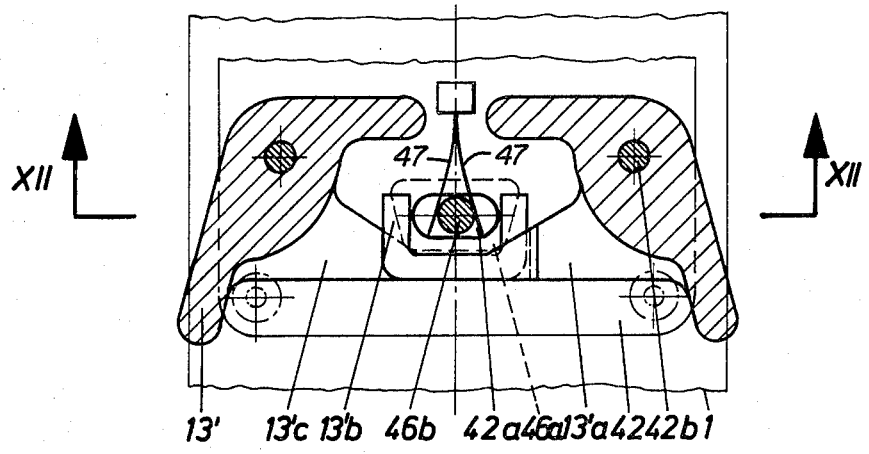
Fig. 11
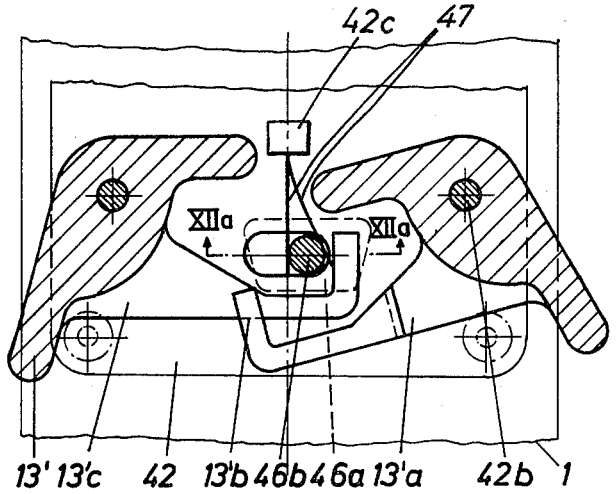
Fig. 12
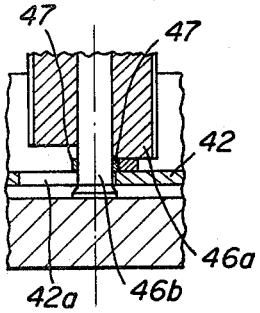
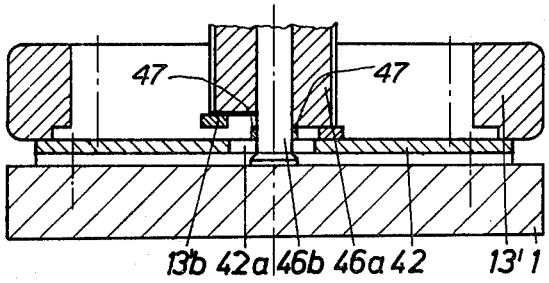
Fig. 12a

SOLE HOLDER

FIELD OF THE INVENTION

The invention relates to a sole holder which can be adjusted in a vertical direction relative to the ski by means of an adjusting screw and is connected to a ski binding part which is associated therewith, wherein the adjusting screw is secured to the ski binding part so that it is prevented from lifting off the ski in a vertical direction relative to the ski.

BACKGROUND OF THE INVENTION

A sole holder of the above-mentioned type is described for example in German OS No. 2 504 426. In this conventional construction, the sole holder is held on an adjusting screw by means of a spiral spring or an elastic element acting in a direction perpendicular to the upper surface of the ski. Due to the fact that the opening in the region of which the adjusting screw substantially perpendicularly extends through the sole holder is designed larger than the diameter of the adjusting screw, the sole holder also has the possibility of a very limited range of swinging movement.

The just now described embodiment of the known device facilitates a recognition at the same time of the first disadvantage of this solution, which disadvantage consists of the sole holder having primarily a movement in the vertical direction relative to the ski.

If ice or snow accumulates in the area of the binding on the ski, the skier can still enter the binding. The sole holder is then, however, pressed onto the ski boot sole by the force of the now initially tensioned spiral spring. A swinging of the sole holder away from the upper side of the ski, which at any rate is possible only to a very limited degree, becomes less and less with an increasing initial tension of the spiral spring.

The goal of the invention is to avoid the mentioned and further disadvantages of known constructions and to provide a sole holder support, which during a safety release has as little as possible frictional resistance between the ski boot, sole holder and the bent lever.

The set purpose is inventively attained by a sole holder being able to be swung slightly upwardly from the ski during an automatic release operation (safety release) on the side facing the release side, wherein the sole holder performs a swinging movement perpendicularly with respect to the longitudinal axis of the ski or in a combined movement about vertical and horizontal axes.

A particularly preferable embodiment of the invention is characterized by the adjusting screw being supported in an elongated slotted hole, the length of which extends perpendicularly with respect to the longitudinal axis of the ski, or having a ball section by means of which it is supported in a ball socket, and by the sole holder being moved into the normal position or being held in the normal position either by a spring or springs an elastic mass or by a combination of springs and shoulders and extensions which are secured to the bent levers. As a result, a particularly simple structure of the ski binding part is achieved.

A different inventive construction of a support for a sole holder uses also a slotted hole, the length of which extends perpendicularly with respect to the longitudinal axis of the ski for guiding the headless end of the adjusting screw. In this exemplary embodiment, the adjusting screw is moved or held in the normal position by shoulders and extensions, which are on the bent lever. If one operates one bent lever, the adjusting screw is no longer blocked, on the side facing the operation, by the shoulders and the extensions and thus permits the sole holder to slightly swing upwardly from the ski on the aforesaid side.

BRIEF DESCRIPTION OF THE DRAWINGS

Further details, advantages and characteristics of the invention will be described more in detail with reference to the drawings which illustrate several exemplary embodiments, in which:

FIG. 10 is a partially sectioned top view of a different exemplary embodiment of a swingable sole holder in nonoperated position thereof;

FIG. 11 is a top view according to FIG. 10 in the operated position thereof;

FIG. 12 is a front view of FIG. 10;

FIG. 12*a* is a sectional view taken along the line XIIa—XIIa of FIG. 11;

DETAILED DESCRIPTION

Figure 1:
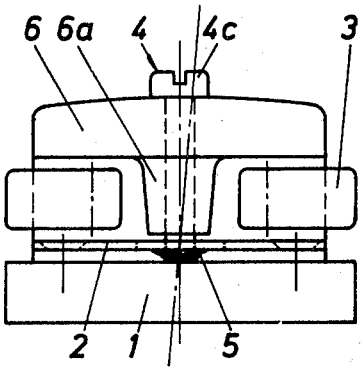
FIG. 1 is a view of a front jaw with a sole holder thereon as viewed in direction toward the tip of the ski, which sole holder is inventively supported by means of an adjusting screw and is illustrated in a nonoperated position.

In FIG. 1 a base plate 2 is mounted on a ski 1 but spaced vertically from the ski. Furthermore, the base plate 2 supports on each lateral side thereof one bent lever 3. A threaded adjusting screw 4 has a headless end and an enlarged head at the opposite end. The screw 4 is supported with its headless end on the base plate 2. A cup spring 5 is interpositioned between the headless end and the base plate 2. This support is provided so that the adjusting screw 4 extends through an opening in the base plate 2, which opening is not identified in detail. The headless end of the adjusting screw 4 is provided in a gap between the base plate 2 and the ski 1. The free bottommost end of the adjusting screw 4 is, after the cup spring 5 was earlier mounted thereon, deformed to lock the cup spring thereto. Thus a movement of the adjusting screw 4 in a direction perpendicular to the upper side of the ski 1*a* is only possible within the limits of elasticity of the cup spring 5.

Figure 2:
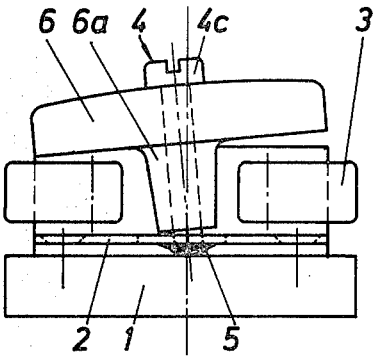
FIG. 2 is a view according to FIG. 1, however, the sole holder is in the operated position.

A sole holder 6 is threadedly engaged with the adjusting screw 4. In the area of the adjusting screw 4, the sole holder 6 has a footlike part 6*a*, which is positioned in the normal position, namely in the nonoperated position according to FIG. 1, approximately perpendicularly with respect to the upper side of the ski 1*a*. FIG. 2 illustrates the position of the sole holder 6 and of the footlike part 6*a* and of the adjusting screw 4 during an operation of these structural parts, namely when the ski boot (not shown) performs not only a lateral movement but also a movement which is directed upwardly from the upper side of the ski 1*a*. In the example according to FIG. 2, we deal with a release movement of the ski boot in the area of the illustrated sole holder 6 in a direction sloped upwardly to the right. The sole holder 6 and its footlike part 6*a* and the adjusting screw 4 thus swing in a direction to the left or to the left and forwardly (in a direction toward the tip of the ski) and thus release the boot 1, which is lifting off from the ski or which is moving away from the ski, with a reduced amount of frictional resistance.

Figure 3:
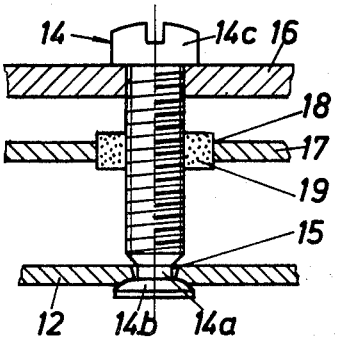
FIG. 3 illustrates a sole holder adjusting screw which can be swivelled all around, which adjusting screw is supported in the base plate and can be pivoted about a support.

FIG. 3 illustrates a different example of a support for a sole holder 16, only the support structure being illustrated, with the aid of an adjusting screw 14. The adjusting screw 14 has adjacent its headless lower end a small diameter neck 14*a*, which transfers into an approximately hemispherical enlargement 14*b* at the lowermost end. The adjusting screw 14 extends through a specially designed opening 15, which will be described more in detail below, in a base plate 12. The narrow diameter neck 14*a* lies in the opening 15 and the semispherical enlargement 14*b* lies beneath the base plate 12. The opening 15 has a downwardly facing surface shaped to correspond to the shape of the upwardly facing semispherical surface on the enlargement 14*b*. The remaining portion of the opening 15 above the downwardly facing surface enlarges conically in a direction toward the screw head 14*c*. A structural part 17 is fixedly connected to the ski binding and is provided approximately in the area of the center of the length of the adjusting screw 14, which structural part has an opening 18 therethrough, the diameter of which is substantially larger than the diameter of the adjusting screw 14. In order to compensate for the difference in diameter between these two structural parts, the binding-fixed structural part 17 has an elastic mass 19 fixedly connected thereto. In the area between the enlarged head 14*c* of the adjusting screw 14 and the binding-fixed structural part 17 there is provided the sole holder 16. The sole holder 16 is threadedly coupled to the adjusting screw 14 and is vertically adjustable by rotating the threaded adjusting screw 14. In addition, it is possible for the adjusting screw 14 and thus also for the sole holder 16, to swing or swivel with the aid of the semispherical support surface 14*b* through an approximately cone-shaped space. If the force which loads the sole holder 16 is halted, then the sole holder 16 is returned to its initial position illustrated in FIG. 3 by the elastic mass 19 acting on the adjusting screw 14.

Figure 4:
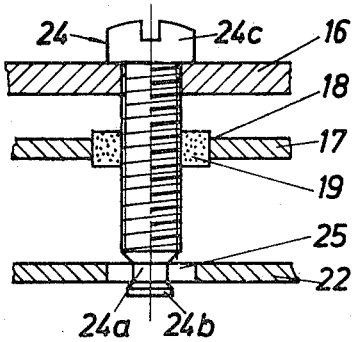
FIG. 4 illustrates substantially the same design as the exemplary embodiment according to FIG. 3 with the difference that the pivot location is between the sole holder and the base plate and the sole holder adjusting screw permits only a swinging perpendicularly with respect to the longitudinal axis of the ski.

The exemplary embodiment which is illustrated in FIG. 4 is constructed substantially similar to the one according to FIG. 3. However, in place of the opening 15 in FIG. 3, an elongated slotted hole 25 is provided, the length of which extends perpendicular to the longitudinal axis of the ski. An upwardly facing conical surface 24*b* is provided below the narrow diameter neck 24*a* on the adjusting screw 24. The largest diameter part of the conical surface is so large that a removal of the adjusting screw 24 from the slotted hole 25 is prevented. The pivot point of the adjusting screw 24 moves now from the area of the base plate 12 as in the exemplary embodiment according to FIG. 3 into the area of the binding-fixed structural part 17. The elastic mass 19 permits now a swinging of the adjusting screw 24 in a direction perpendicular to the longitudinal axis of the ski.

Figure 5:
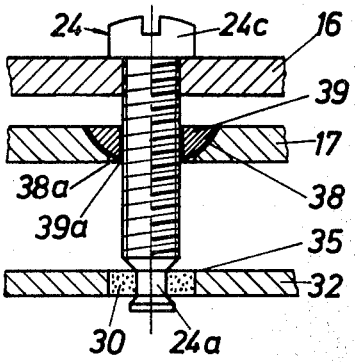
FIG. 5 illustrates a further exemplary embodiment of a sole holder adjusting screw swivelably supported for movement in all directions.

The exemplary embodiment which is illustrated in FIG. 5 is substantially similar to the exemplary embodiments according to FIGS. 3 and 4. In place of the slotted hole 25 according to FIG. 4, an enlarged cylindrical or circular opening 35 is provided. The opening 35 is filled with an elastic mass 30, which elastic mass 30 grips around a narrow diameter neck 24*a* of the adjusting screw 24 which is received in the opening 35. The binding-fixed structural part 17 has, in the area of the adjusting screw 24, an upwardly opening semispherical surface 38 which has a semispherical bearing part 39 received therein. As can be seen from the drawing, the semispherical bearing part 39 has a central opening 39*a* therethrough, which serves to receive the adjusting screw 24 therethrough. The bottom portion of the semispherical surface 38 has an enlarging opening 38*a* less in diameter than the maximum diameter of the semispherical surface 38.

During a swinging of the sole holder 16, the adjusting screw 24 can, with the aid of the semispherical bearing part 39, swing in the semispherical surface 38 and through the space of a cone. Thus the swivel point lies in the binding-fixed structural part 17. The elastic mass 30 permits the adjusting screw 24 to swing in the area of the base plate 32. When the force, which causes the swinging movement, stops acting onto the sole holder 16, the sole holder is moved by the elastic mass 30 into its original position, namely into its nonoperated position as illustrated in FIG. 5.

Figure 6:
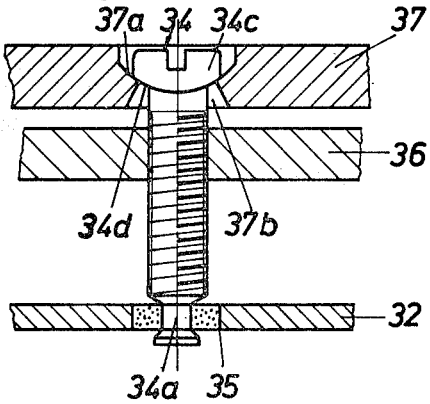
FIG. 6 illustrates also an all around swivelable sole holder adjusting screw.

In the exemplary embodiment according to FIG. 6, a threaded adjusting screw 34 is also provided. The design of the adjusting screw 34 at its end remote from the enlarged head 34*c* is substantially the same as the adjusting screw 24 illustrated in FIG. 5. The base plate 3 has also in FIG. 6 an opening 35, which is filled with an elastic mass 30 which grips around the narrow diameter neck 34*a*. The adjusting screw 34 is swingably supported in a binding-fixed structural part 37 adjacent the head 34*c*. The enlarged head 34*c* has for this purpose a spherical-segment-shaped bottom surface 34*d*. The spherical-segment-shaped bottom surface 34*d* of the head of the adjusting screw 34 lies in an upwardly opening spherical-segment-shaped cup 37*a* provided in the binding-fixed structural part 37. The surface 37*a* extends in the binding-fixed structural part 37 to approximately the diameter of the adjusting screw 34. A downwardly opening conically-shaped opening 37*b* extends from the central part of the surface 37*a* in direction of the headless lower end of the adjusting screw 34. The binding-fixed structural part 37 is rather thick in this exemplary embodiment so that the top of the head 34*c* of the adjusting screw 34 is generally flush or slightly below the upper surface of the part 37. The sole holder 36 is located in the area between the binding-fixed structural part 37 and the base plate 32. The adjusting screw 34 can in this case pivot about the head 34*c* supported on the spherical-segment-shaped surface 37*a*. The pivot point is generally in the region of the center of the radius for the spherical-segment-shaped surface 37*a*. The elastic mass 30 permits the swinging movement of the adjusting screw 34 in any direction and effects a return movement of the adjusting screw 34 into the original position illustrated in FIG. 6 after the force which acts onto the sole holder 36 has been halted.

Figure 7:
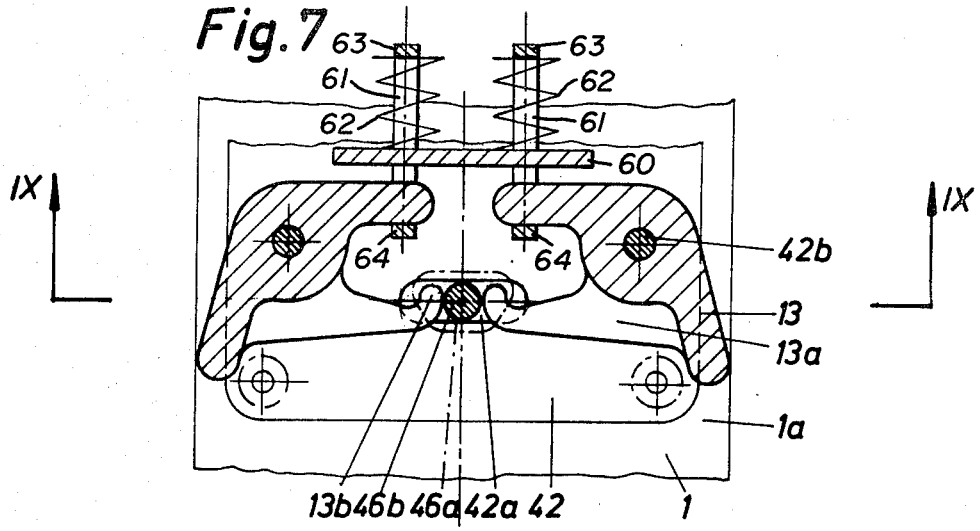
FIG. 7 is a partially sectioned top view of an arrangement of two bent levers and one sole holder adjusting screw in the nonoperated position thereof.
Figure 8:
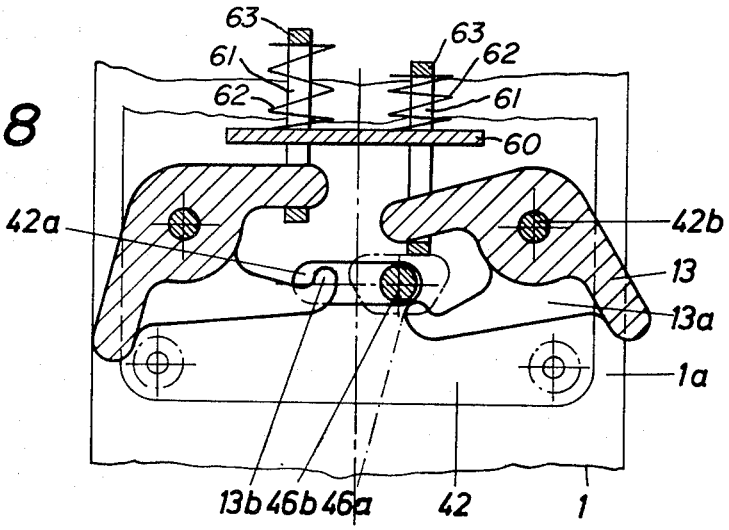
FIG. 8 is a top view according to FIG. 7 in the operated position thereof.
Figure 9:
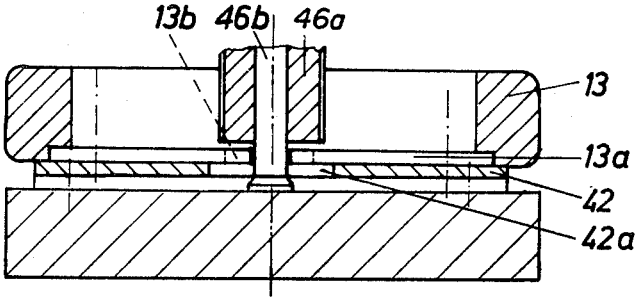
FIG. 9 is a front view of FIG. 7.

FIGS. 7 to 9 illustrate an adjustable lock for a sole holder, wherein the illustration and the following description is limited only to the characteristics and structural parts which are important to the invention. A substantially rectangular base plate 42 having a constant thickness and a width which is slightly less than the width of the ski 1 is mounted on the upper surface of a ski 1. The base plate 42 has in the area of the longitudinal axis of the ski an elongated slotted hole 42*a*, the length of which extends perpendicularly to the longitudinal axis of the ski and is substantially symmetrical with respect to same. Furthermore, the base plate 42 has on each side thereof a hinge pin 42*b*, the axis of which extends perpendicularly with respect to the upper side of the ski 1*a*. Each bent lever 13 is pivotally supported on one of the hinge pins 42*b*. Each of the two bent levers 13 has on its side adjacent the base plate 42 a flat shoulder 13*a* which extends in direction toward the longitudinal center of the ski. The thickness of the shoulder 13*a* corresponds approximately to the thickness of the base plate 42. The two shoulders 13*a* have at their mutually adjacent ends adjacent the longitudinal center of the ski an extension 13*b* which extends in a direction toward the tip of the ski. The ends of the extensions 13*b* are rounded; the radius of these shoulders is approximately as long as the width of each of the extensions 13*b*.

In the normal position, namely when no external force acts onto the bent levers 13, as illustrated in FIG. 7, the extensions 13*b* are located approximately above the slotted hole 42*a* in the base plate 42. Enough space remains between the two extensions 13*b* that a cylindrical part 46*b*, which is arranged on a footlike part 46*a* of a sole holder (not shown) can be received therebetween. The cylindrical part 46*b* projects into the slotted hole 42*a* of the base plate 42.

If now a ski boot (not shown) tends to lift off in direction to the right and at the same time in an upward direction from the binding, the following will happen. The lateral movement of the boot will cause the bent lever 13 to swing, as illustrated in FIG. 8, to the right in direction away from the ski. As a result, the shoulder 13*a* will also swing in the same direction as the bent lever 13. In addition, the extension 13*b* will be moved from the original position and away from an overlapping relation with the slotted hole 42*a*. It is now possible for the cylindrical part 46*b*, which is provided on the footlike part 46*a* of a sole holder (not shown), to slide in the slotted hole 42*a* in the direction of the pivoted bent lever 13. The aforesaid sliding movement will cause the footlike part 46*a* and thus also the sole holder (not shown) to assume a pivoted position to in turn cause the sole holder to be slightly lifted off from the ski 1 in the area of the pivoted bent lever 13. Thus the friction between a ski boot (not shown) and the sole holder or the pivoted bent lever 13 is considerably reduced. The cylindrical part 46*b* corresponds to the lower end of a screw such as the screws 24 shown in FIG. 4, which screw extends through the opening 25.

When the ski boot (not shown) has totally exited from the ski binding, the cylindrical part 46*b* will be centered as by the return spring force of the spring device as illustrated in FIG. 7. The spring device shown in FIG. 7 includes a vertical plate 60 transversely mounted on the base plate 42 and through which vertical plate passes a pair of tension rods 61 about one end of each of which is located a compression coil spring 62. The one end of the springs 62 abut against the plate 60 and the other end is retained by a crosspiece 63 secured to the front end of each of the rods 61. The rear end of the rods 61 are each pivotally fixed at 64 to the levers 13. Such a spring device continually urges the levers 13 to their ski boot holding position shown in FIG. 7. This solution is similar to the spring device shown in U.S. Pat. No. 3,950,002. As a result, the sole holder will also pivot again into the original position and lie parallel with respect to the upper side of the ski and be held in this position.

From FIG. 9, one can see that the sole holder can swing only when the bent levers 13 have been operated until they release the cylindrical part 46*b*.

The exemplary embodiment according to FIGS. 10 to 12 is designed substantially similar to the one which has been described above with reference to FIGS. 7 to 9. A substantially rectangular base plate 42 of constant thickness is mounted on a ski 1, which base plate has in the region of the longitudinal axis of the ski an elongated slotted hole 42*a*, the length of which is symmetrical with respect to same and lies perpendicular thereto. Each cylindrical hinge pin 42*b* is laterally spaced from the center line of the ski and is secured to the base plate 42 and extends perpendicular with respect to the base plate. Each bent lever 13′ is pivotally supported through a limited range on one of the hinge pins 42*b*.

Each of the two bent levers 13′ has on its side adjacent the upper surface of the base plate 42 a flat shoulder 13′*c* which extends in direction toward the center of the ski. The vertical thickness of the shoulder 13′*a* corresponds approximately with the vertical thickness of the base plate 42. The two shoulders 13′*c* have at their ends which are adjacent the center of the ski an extension 13′*b* which extends in a direction toward the tip of the ski. In the original position, namely when no external force acts onto the bent levers 13′, as is illustrated in FIG. 10, the extensions 13′*b* extend in a direction toward the opposite bent lever 13′ across a part of the slotted hole 42*a*.

As is shown in FIG. 12, the flat shoulder 13′*a* on the right bent lever 13′ is doubly bent so that its extension 13′*b* will lie above the flat shoulder 13′*c* associated with the left bent lever 13′. The flat shoulder 13′*c* which is opposite the doubly bent flat shoulder 13′*a* is substantially symmetrical but for the bent section.

A cylindrical part 46*b* of the footlike part 46*a* of a sole holder (not shown) is received in an elongated slotted hole 42*a*. The footlike part 46*a* of the sole holder is constructed so stepped, that in the normal position thereof, namely when no force acts onto the bent levers 13′, as illustrated in FIG. 10, the footlike part 46*a* rests on the extensions 13′*b*. The cylindrical part 46*b* is held in the central position by means of two plate springs 47 being arranged on a hexahedronlike bearing portion 42*c*. The cylindrical part 46*b* is biassed therefore with respect to the top of the ski (not shown) from the left and right side respectively.

If a right bent lever 13', as illustrated in FIG. 11, is operated by a ski boot (not shown) so that the ski boot becomes released from the binding, the right extension 13'b is swung out from under the footlike part 46a (see FIG. 12a), and the right sole holder can thereafter swing in a counterclockwise direction.

The ski boot will slide substantially more easily out of the ski binding due to the swinging movement of the sole holder. If the force which acts from the ski boot onto the bent lever 13' is halted, then the bent lever 13' and also the flat shoulder 13'a with the extension 13'b, will return to the original position, the extensions 13'b extending beneath the footlike part 46a, to assure a safe locking of the sole holders against an undesired swinging movement. At the same time the plate spring 47 belonging to the released side will return to the original position and so the cylindrical part 46b has to move to its original central position too.

Figure 13:
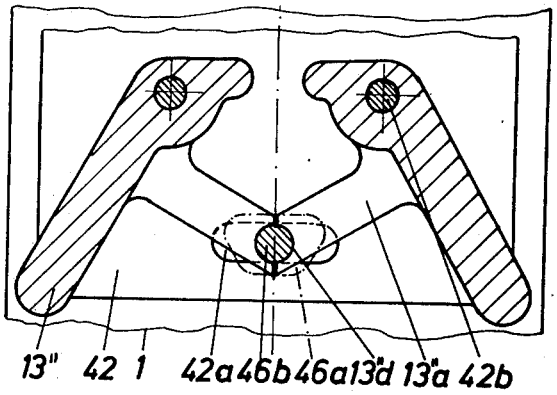
FIG. 13 is a top view partly in cross section of a further exemplary embodiment of a swingable sole holder.
Figure 14:
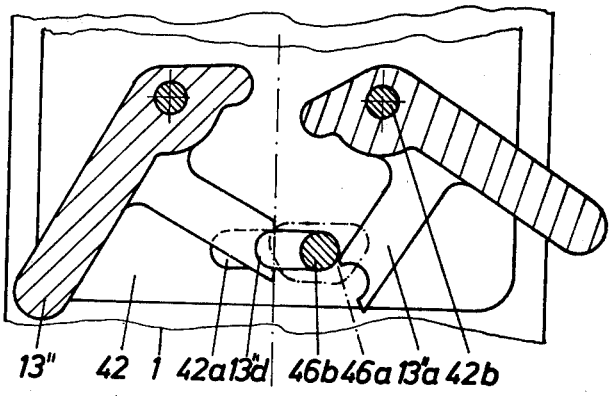
FIG. 14 is a plan view according to FIG. 13 in the operated position thereof.
Figure 15:
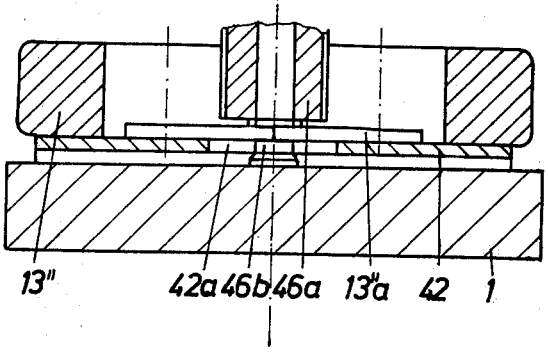
FIG. 15 is a front view of FIG. 13.

The exemplary embodiment which is illustrated in FIGS. 13 to 15 is substantially similar in structure to the two exemplary embodiments which are illustrated in FIGS. 7 to 12. Therefore, only those structural parts which differ from the two aforedescribed exemplary embodiments will be described hereinbelow.

Bent levers 13'' are pivotally supported through a limited range on cylindrical hinge pins which are secured to and extend perpendicularly upwardly from the base plate 42. The bent levers 13'' have flat shoulders 13''a on their sides which are adjacent the base plate 42. The flat shoulders 13''a extend in a direction toward the longitudinal axis of the ski and terminate in the region of the central longitudinal axis of the ski. The shoulders 13''a project at such an angle from the bent lever 13'' that they, in the nonoperated position thereof, namely when, as shown in FIG. 13, no force acts onto the bent levers 13'', will lie above an elongated slotted hole 42a which is provided in the base plate 42. Each of the flat shoulders 13''a has at its end which lies in the area above the slotted hole 42a a semispherical recess 13''d. The two mutually adjacent semispherical recesses 13''d on the flat shoulders 13''a enclose a cylindrical part 46b secured to the footlike part 46a of a sole holder. The cylindrical part 46b extends into the slotted hole 42a. The two flat shoulders 13''a hold in the normal position thereof, as illustrated in FIG. 13 and with the aid of the semispherical recesses 13''d the cylindrical part 46b approximately in the center of the slotted hole 42a.

If the right bent lever 13'' is moved by a ski boot (not shown) as illustrated in FIG. 14, the cylindrical part 46b can slide in the slotted hole 42a in a direction toward the operated bent lever 13''. This sliding movement of the bent lever 13'' in the slotted hole 42a facilitates the sole holder to swing and cause it to become positioned higher in the region of the operated bent lever 13''. This reduces the friction between the ski boot and the sole holder. If the force which operates the bent lever 13'' is halted, the lever 13'' will return to the position illustrated in FIG. 13. During this swinging movement, the cylindrical part 46b will also move over the flat shoulders 13''a in the slotted hole 42a into the centered position thereof as illustrated in FIG. 13.

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. A device for engaging and holding a sole of a ski boot to a ski, comprising:

base means adapted to be mounted to the upper surface of said ski and having first means defining an opening therein;

lever means pivotally secured to said base means for movement between first and second positions and at a location spaced from said opening, said lever means including second means adapted to engage the sole of said ski boot when in said first position thereof;

a sole holder located above said lever means and including third means adapted to engage the top edge of said sole of said ski boot and fourth means for movably securing said sole holder to said base means and for movement between first and second positions, said fourth means including a normally vertically aligned elongated fastener, the lower end of which is received in and guided in said opening, said fastener being movable relative to said base means in a vertical plane extending transverse to the longitudinal axis of the ski in response to a movement of at least one of said sole holder and said lever means between said first and second positions thereof, said first position of said sole holder and said lever means corresponding to said vertically aligned position of said fastener, said second position of said sole holder and said lever means corresponding to a position of said fastener inclined to said normal vertically aligned position thereof; and resilient means for continually urging said fastener to said vertically aligned first position.

2. The device according to claim 1, wherein said opening is an elongated slotted hole, the length of which extends perpendicularly with respect to the longitudinal axis of the ski, wherein said fastener is an adjusting screw, the lower end of which is received in said elongated slotted hole, and wherein said sole holder is movable into said first position by said resilient means and is held in said first position by said adjusting screw and said resilient means.

3. The device according to claim 2, wherein said resilient means which urges said sole holder toward said first position is arranged in said base means and encloses said adjusting screw.

4. The device according to claim 2, wherein said adjusting screw and, consequently, said sole holder, are pivotally supported on said base means, the location of the pivot for said sole holder and said adjusting screw being in the region of a binding-fixed structural part.

5. The device according to claim 1, wherein said fastener is an adjusting screw, and wherein said adjusting screw which engages said sole holder has a spherical-segment-shaped bottom surface and is supported on a similarly shaped surface on a binding-fixed structural part and for a limited range of movement in all directions.

6. The device according to claim 2, wherein said base means includes a base plate, wherein said adjusting screw which holds the sole holder has in the region of said base plate a narrow diameter neck.

7. The device according to claim 6, wherein said narrow diameter neck extends through said base plate in the region of said slotted hole.

8. The device according to claim 7, wherein said adjusting screw which holds said sole holder has a part below said narrow diameter neck, the diameter of which part is larger than the diameter of said narrow neck and functions to fixedly hold said adjusting screw against movement in the vertical direction relative to said ski.

9. The device according to claim 1, wherein said sole holder is pivotal about differing axes relative to said base means, wherein said differing axes include a first axis extending perpendicularly with respect to the upper surface of said ski and a second axis extending perpendicular to said first axis.

10. The device according to claim 1, wherein said fastener includes an adjusting screw, wherein said lever means includes a pair of bent levers, each having shoulder means thereon located on opposite sides of said lower end of said adjusting screw to hold, in addition to said resilient means, said lower end in a fixed relation to said base means when said adjusting screw is in said normally vertically aligned position.

11. The device according to claim 1, wherein said fastener is an adjusting screw, and wherein said adjusting screw has an enlarged head engaging a binding fixed structural part, said head having a spherical-segment-shaped bottom surface and being supported on a similarly shaped surface on said structural part and for a limited range of movement in all directions.

12. The device according to claim 1, wherein said fastener is an adjusting screw, the lower end of which is received in said opening, wherein said opening has a spherical wall surface, wherein said adjusting screw has a spherical segment engaging said spherical wall surface by means of which it is supported on said base means.

13. The device according to claim 1, wherein said first and second positions of said lever means correspond, respectively, to a ski boot holding position and a ski boot releasing position, wherein said lever means includes shoulder means thereon for restricting said movement of said fastener only when said lever means is in said ski boot holding position.

14. The device according to claim 13, wherein said shoulder means includes means for assuring a movement of said fastener only toward the side of said ski in which said ski boot is released.

15. In a front jaw member of a safety ski binding having a base plate adapted to be mounted to an upper surface on a ski and a pair of laterally spaced levers pivotally secured to said base plate and for movement between first and second positions, which levers have means thereon adapted to engage at least the sides of the sole of a ski boot to releasably hold said ski boot in said ski binding, the pivot axes of said levers being oriented perpendicular to said upper surface of said ski, a sole holder located above and extending between said levers, said sole holder including means for engaging the top edge of the toe of said ski boot to prevent the toe of said ski boot from inadvertently lifting off from said ski when said levers are in said first position, an adjusting screw for securing said sole holder to said base plate, the longitudinal axis of said adjusting screw extending perpendicularly with respect to the upper surface of said ski, the improvement comprising wherein said adjusting screw includes means for supporting same for movement in a plane perpendicular to the upper surface of said ski, which plane also extends transversely with respect to the longitudinal axis of said ski so that the lateral edges of said sole holder can be moved vertically in response to laterally and vertically applied forces to said ski boot tending to eject said ski boot from said ski binding, and resilient means for continually urging said longitudinal axis of said adjusting screw to said position perpendicular to said upper surface of said ski.

* * * * *